United States Patent [19]

Dalebout et al.

[11] Patent Number: 5,034,576

[45] Date of Patent: Jul. 23, 1991

[54] CONSOLE SWITCH

[75] Inventors: William T. Dalebout; Kent Ashby, both of Logan, Utah

[73] Assignee: Proform Fitness Products, Inc., Logan, Utah

[21] Appl. No.: 482,223

[22] Filed: Feb. 20, 1990

[51] Int. Cl.[5] ..... H01H 27/06

[52] U.S. Cl. ..... 200/43.04; 200/43.08; 200/330; 200/334; 200/332; 272/69

[58] Field of Search ..... 200/43.04, 329, 330, 200/331, 334, 43.08, 543; 272/69; 74/523; 180/272; 246/186

[56] References Cited

U.S. PATENT DOCUMENTS

| | | | |
|---|---|---|---|
| 3,542,977 | 11/1970 | Thornley | 200/43.08 |
| 3,711,812 | 1/1973 | Cherry | 338/200 |
| 3,714,383 | 1/1973 | Leonard et al. | 200/43.08 |
| 4,250,358 | 2/1981 | Gilbertson | 200/543 |
| 4,454,392 | 6/1984 | Rapp et al. | 200/334 |
| 4,458,115 | 7/1984 | Peterson | 200/61.85 |
| 4,539,452 | 9/1985 | Draxler et al. | 200/543 |
| 4,563,552 | 1/1986 | Fushimoto | 200/17 R |
| 4,695,684 | 9/1987 | Bochard et al. | 200/43.04 |
| 4,762,968 | 7/1988 | Hilton | 200/543 |
| 4,771,148 | 9/1988 | Bersonnet | 200/61.58 R |
| 4,904,829 | 2/1990 | Berthaud et al. | 200/43.04 |

FOREIGN PATENT DOCUMENTS

| | | | |
|---|---|---|---|
| 957088 | 5/1964 | United Kingdom | 200/43.04 |

OTHER PUBLICATIONS

Precor, Inc. of Bothell, WA Advertised a Treadmill in a 1988 Brochure which mentioned a "Unique Safety Key".

Vitamaster, of Tyler, TX, published a product instruction book showing treadmills with a "safety pull pin".

*Primary Examiner*—Renee S. Luebke
*Assistant Examiner*—Glenn T. Barrett
*Attorney, Agent, or Firm*—Trask, Britt & Rossa

[57] ABSTRACT

A switch apparatus for an electrical machine comprises a keyway and a removable key. A spring-loaded protrusion on the key prevents direct insertion of the key into an "ON" position, and communicates with a guideway for movement of the key between the "OFF" and "ON" positions. The key is directly removable from both the "ON" and "OFF" positions simply by pulling, to deactivate the machine in an emergency or accident. Unauthorized and accidental operation of the machine may be prevented by control of the key.

14 Claims, 6 Drawing Sheets

CONSOLE SWITCH

BACKGROUND OF THE INVENTION

1. Field

This invention relates to electrical switches. More particularly, the invention pertains to electrical safety switches for exercise machines and the like.

2. State of the Art

Safety of the user is a major concern in the design and manufacture of powered machines. Powered treadmills and like machines having exposed moving parts may injure a user who accidently or deliberately misuses the machine. The popular domestic use of such machines recommends use of means to prevent accidental activation by children, pets or others. In addition, the possibility of a user falling on or from a machine makes it desirable to have a mechanism by which the machine may be de-activated in such events. A mechanism to prevent or eliminate "surprise" activation is desirable. In addition, some means to automatically and immediately halt the machine in case of an accident is desirable.

BRIEF DESCRIPTION OF THE INVENTION

An apparatus for controlling the activation of an electrically powered machine such as an exercise treadmill includes a keyway with an electrical switch, and a removable key for prevention of accidental activation by children. By insertion in the keyway, a normal OFF position is attained. The key may then be normally hand manipulated between the "OFF" position and an "ON" position. Means are provided to maintain the key in the desired position, yet permit ready movement to the other position for activating or deactivating the machine.

In addition, a "panic" feature permits immediate deactivation of the machine by simply retracting the key from the keyway. The key may be directly pulled from the keyway whether the key is in an "OFF" or an "ON" position. Thus, for example, a lanyard may connect the key to a clip attached to the user's clothing. If the user slips or falls on the machine, the key will be pulled from the keyway to immediately stop the machine.

The removable key enables the prevention of accidental or unauthorized activation of the machine by children, pets or others to whom it is accessible. The invention also prevents activation immediately upon insertion of the key, but requires a second motion of the hand or finger to activate the machine.

DESCRIPTION OF THE PREFERRED EMBODIMENTS

Figure 1:
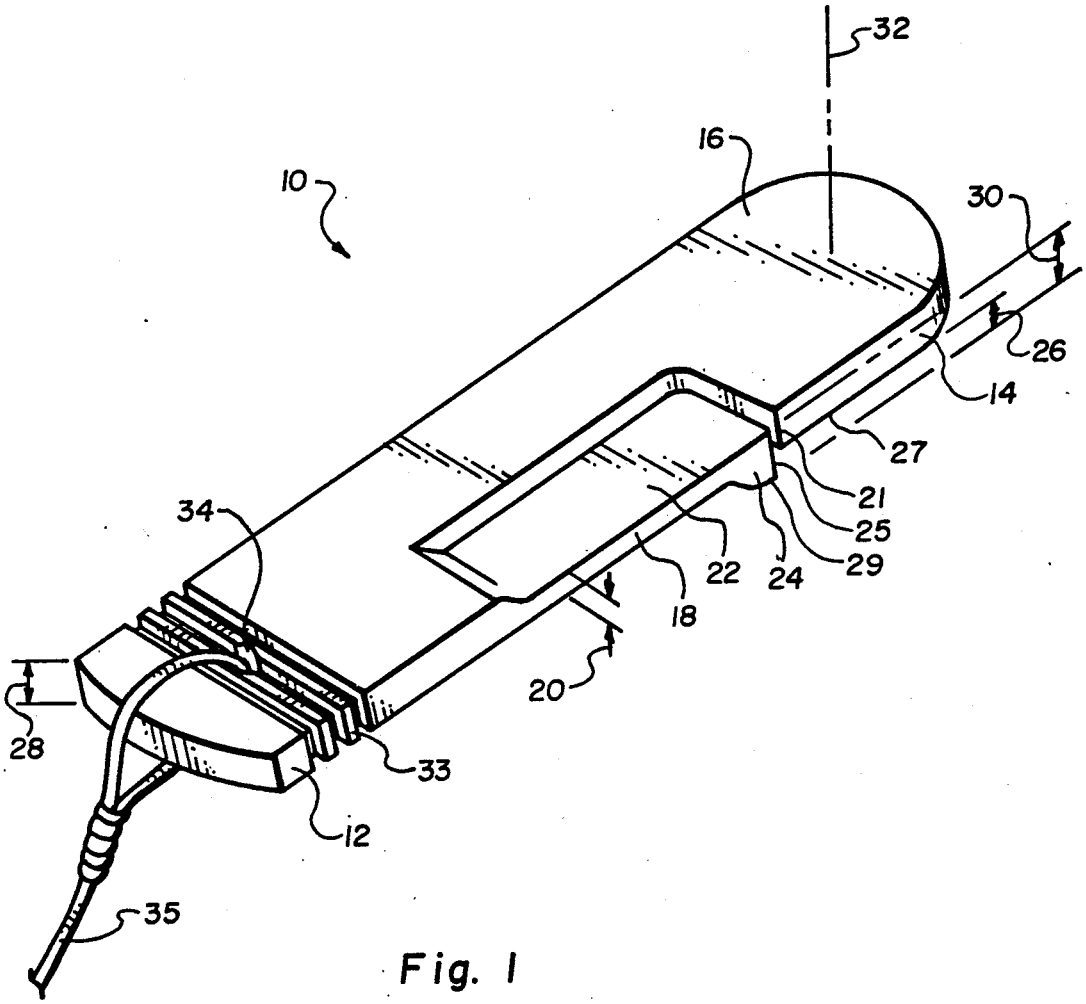
FIG. 1 is a perspective view of the safety key of the invention.

As depicted in FIG. 1, safety key 10 is an elongate member with proximal end 12 which is hand manipulable and distal end 14 which is adapted to be inserted into a keyway of a keyway housing. This embodiment has a generally planar upper surface 16 and includes a resilient elongate arm 18 of reduced thickness 20. Arm 18 is separated from the remainder of the key 10 by L-shaped gap 21. The upper surface 22 of arm 18 is displaced downwardly from surface 16. The distal end 23 of arm 18 includes a downward extending protrusion 24 with a generally flat forward vertical surface 25 extended downwardly a distance 26 from lower surface 27 of the key 10. The purpose of this protrusion 24 will be later described.

The thickness 28 of key 10 provides for a generally rigid key. The reduced thickness 20 of arm 18 provides resilience and allows the arm to flex upwardly to where the most protruding surface 29 of protrusion 24 is generally coincident with the lower edge 27 of the key 10. In this position, the upper surface 22 does not rise above the level of surface 16. In other words, the vertical dimension 30 of the arm 18 and protrusion 24 is not significantly greater than the general thickness 28 of the key 10.

Safety key 10 may be turned about axis 32 in its distal end 14 to activate and deactivate the machine through switch actuator 70.

The proximate end 12 preferably includes means 33 for increasing friction in handling, so that it may be easily held and manipulated. In this embodiment, handle means are shown as slots 33 formed in the proximal end 12.

The key 10 preferably includes a lanyard hole 34 or other means for attaching a lanyard 35. The lanyard 35 may be attached to a clip or other device for attachment, not shown, to the clothing or person of the user. Thus, during use, tripping and/or a fall of the user will result in the key 10 being pulled from the keyway housing 36 shown in FIG. 2, to immediately deactivate the machine.

Figure 2:
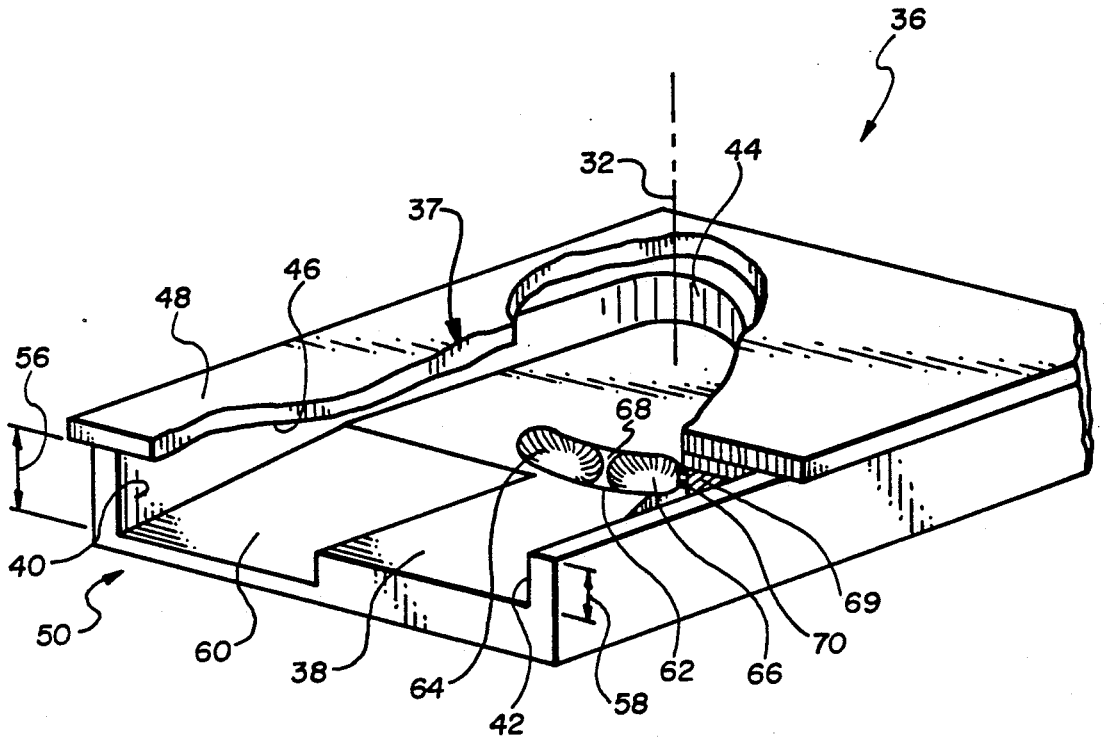
FIG. 2 is a perspective, partially cutaway view of the keyway of the invention.
Figure 3:
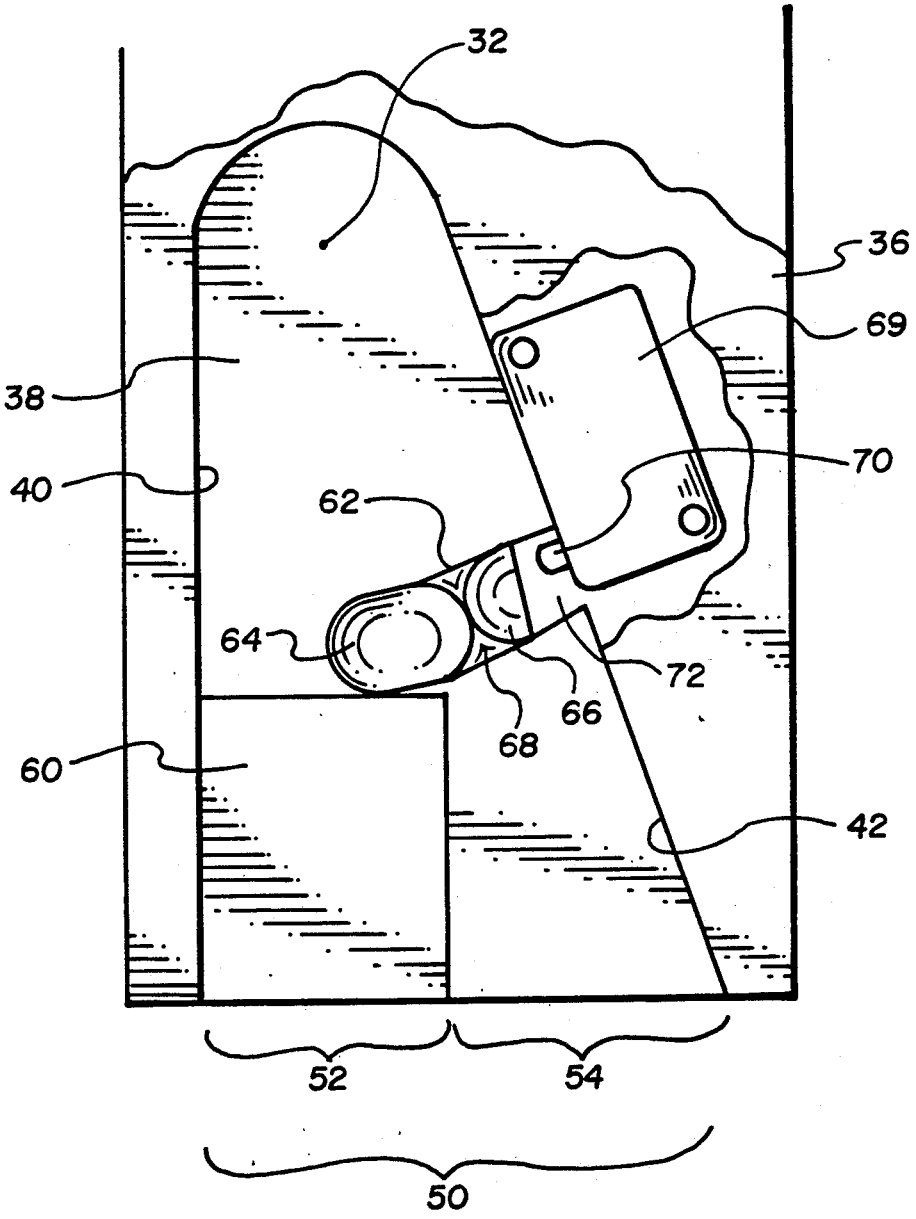
FIG. 3 is a partially cutaway plan view of the keyway of the invention.

FIGS. 2 and 3 show the keyway housing 36 into which key 10 is inserted for machine operation. The keyway housing 36 defines the keyway 37, and has a base 38, sidewalls 40 and 42, curved rear wall 44, and the inner surface 46 of cover 48. The front opening 50 of keyway 37 has two portions, i.e., an insertion opening 52 and an activation opening 54, both shown in FIG. 3. The vertical dimension 56 of the insertion opening 52 is greater than the vertical dimension 58 of the activation opening 54, and vertical dimension 56 meets or exceeds the combination of key thickness 28 and protrusion distance 26. This permits insertion of key 10 with protrusion 24 into insertion opening 52. The thickness 28 of safety key 10 is slightly less than dimension 58 so that the key easily slides in the keyway 37.

Base 38 is shown as including a ramp 60 in which the keyway thickness is uniformly decreased from that of dimension 56 to that of dimension 58. As safety key 10 is inserted into insertion opening 52 and moved rearwardly therein, protrusion 24 is gradually compressed upwardly to a compressed condition. As the key is fully inserted the protrusion 24 drops into guideway 62 which comprises a groove in base 38. The key 10 is now in a fully inserted normally "OFF" position, and may be rotated about axis 32 in its distal end to an "ON" position.

Guideway 62 is, in this embodiment, a groove which guides the protrusion 24 between the "OFF" and "ON" positions. Preferably, groove 62 includes two deepened depressions 64 and 66, respectively, for retaining the protrusion 24 in the respective "OFF" and "ON" positions. A rib or slight elevation 68 presents the desired resistance to movement between the two positions. In addition, the depressions 64 and 66 present resistance to movement of the protrusion outward in response to a force removing the key from the keyway.

A switch housing 69 is positioned with its actuator 70, e.g. a push button, within depression 66, so that movement of key 10 to the "ON" position activates the actuator 70. In the embodiment shown, a portion 72 of depression 66 is recessed to avoid interference with operation of actuator 70.

Turning now to FIGS. 4 through 8, the operation of key 10 within keyway 37 is illustrated in more detail. Key 10 is shown in phantom in an "OFF" position 74 in keyinsertable portion 52 and also in an "ON" position 76 in non key-insertable portion 54.

Figure 4:
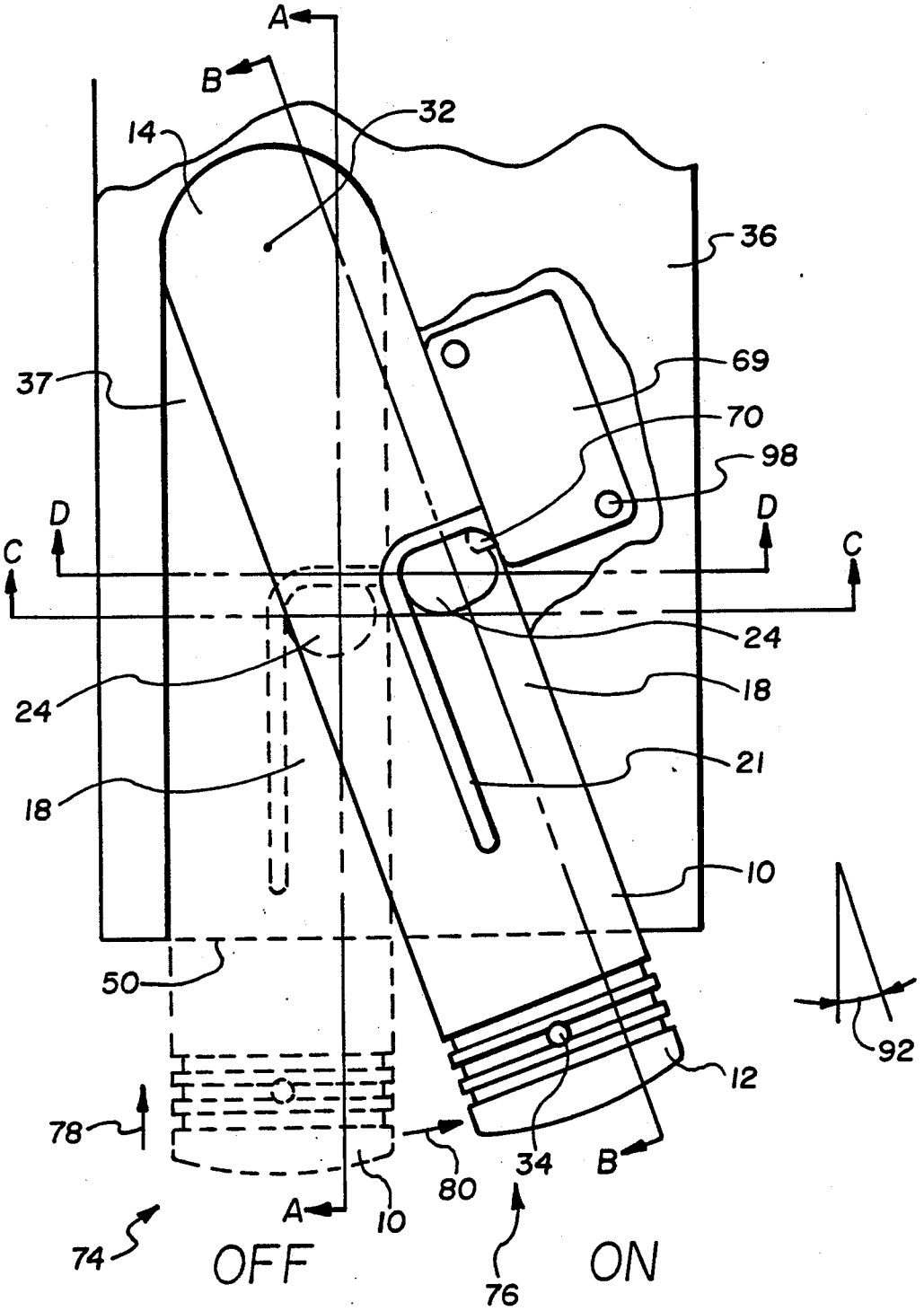
FIG. 4 is a partially cutaway plan view of the keyway showing the key in an "ON" position and in a phantom "OFF" position.
Figure 5:
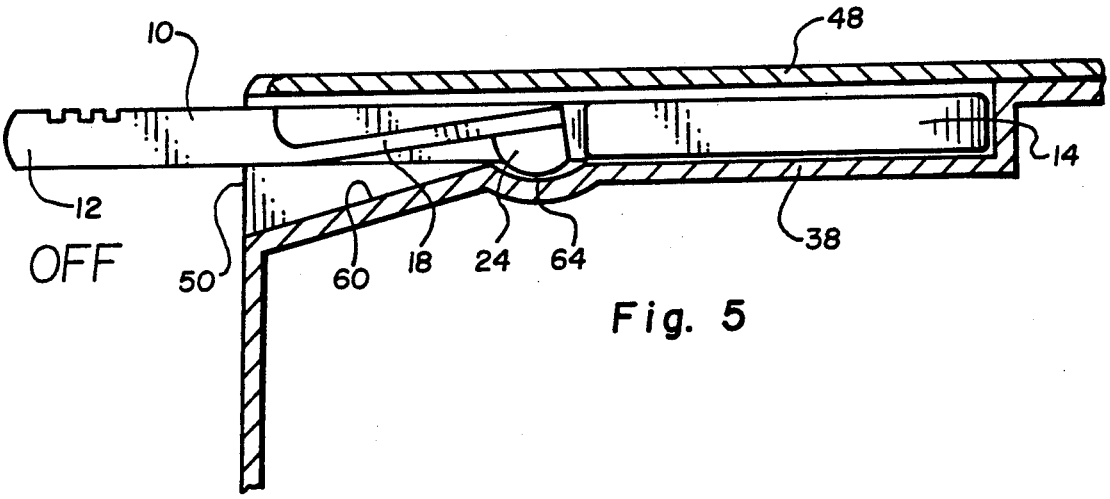
FIG. 5 is a sectional view of the invention along lines A—A of FIG. 4.
Figure 6:
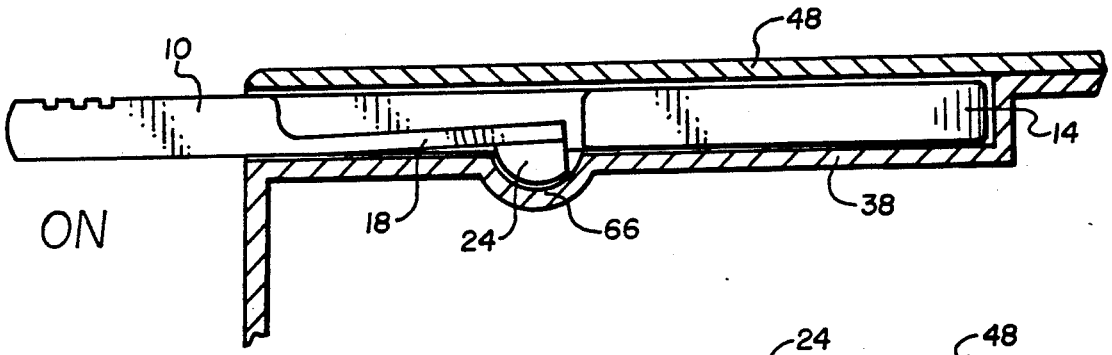
FIG. 6 is a sectional view of the invention along lines B—B of FIG. 4.
Figure 7:
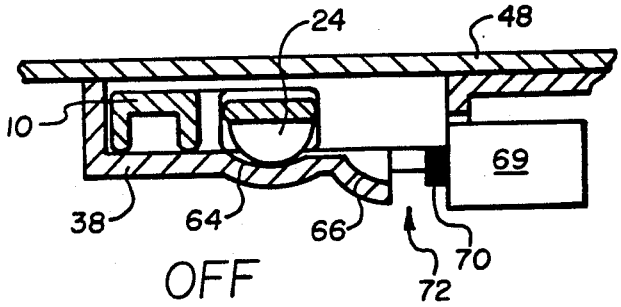
FIG. 7 is a sectional view of the invention along lines C—C of FIG. 4.
Figure 8:
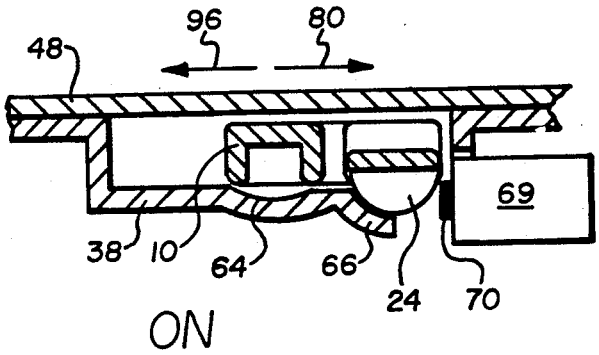
FIG. 8 is a sectional view of the invention along lines D—D of FIG. 4.

Looking at the "OFF" position as depicted in FIGS. 4, 5, and 7, key 10 is shown fully inserted into keyway 37 with protrusion 24 resting in first depression 64 and arm 18 partially compressed upwards.

This "OFF" position was attained by inserting distal end 14 of the key into the key-insertable portion 52 (See FIG. 3) in direction 78, until arm 18 reached a fully compressed condition and the protrusion 24 subsequently dropped into depression 64.

The "ON" position is then attained by moving the proximate end 12 of the key 10 in direction 80 within the keyway until protrusion 24 falls into second depression 66 and activates the switch actuator 70 to start the machine.

In the preferred form, second depression 66 is deeper than the first depression 64 in order to overcome the spring force of the push button spring-loaded actuator 70 of switch 69, as well as to prevent vibration of the operating machine from moving protrusion 24 out of depression 66, turning off the machine.

Figure 9:
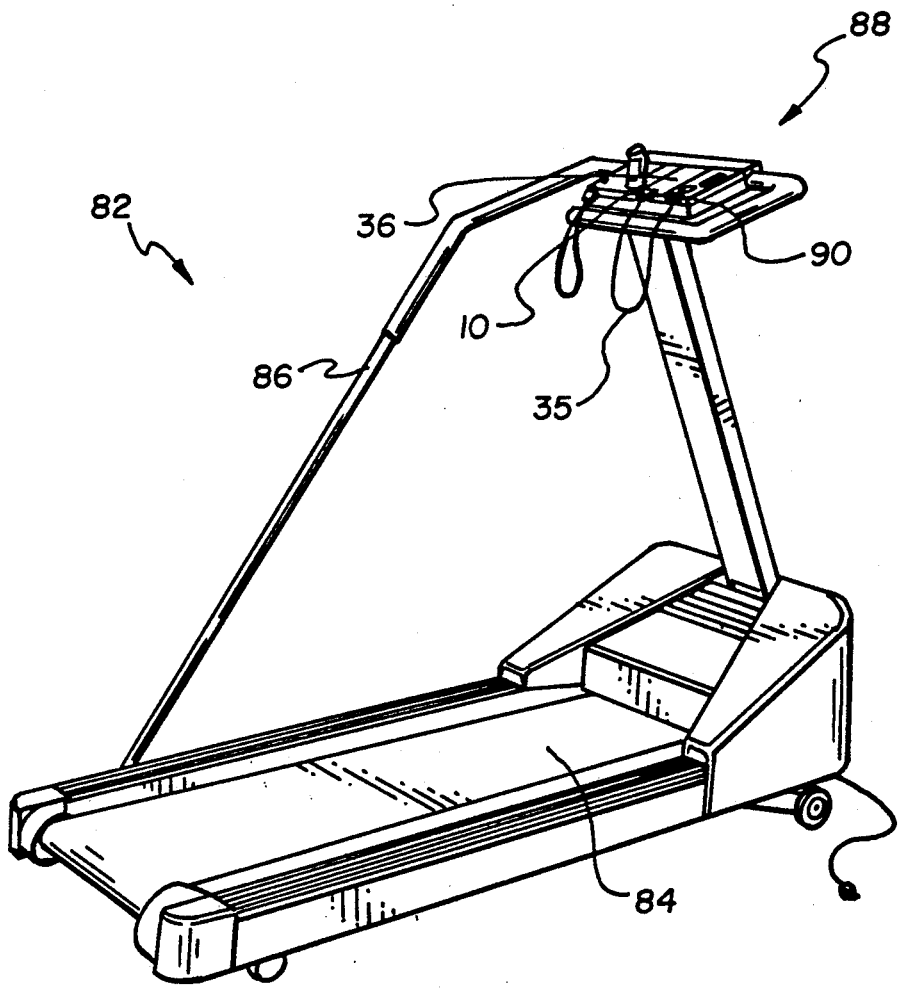
FIG. 9 is a perspective view of the invention adapted to an exercise treadmill machine.

An exercise treadmill 82 using the invention is depicted in FIG. 9. The treadmill includes belt 84, side rail 86 and control console 88. A keyway housing 36 is part of console 88, and is shown with a safety key 10 inserted therein. A lanyard 35 is attached to the key 10 and has a clothing clip 90 attached at its other end. When clip 90 is attached to a users clothing, any movement beyond the range of the lanyard 35 will pull the key 10 from the keyway housing 36, shutting off the machine.

In this application, key 10 is typically about 4½ inches in length, one inch in width, and ¼ inch in thickness. Protrusion 24 extends downward from the arm about 3/16 inch. Arm 16 is about 1½ inches long.

The activation device of the invention may be used with any electrically powered machine. It is especially adapted to machines requiring control of its use, i.e., to prevent unauthorized use. Machines which may present danger if accidently activated may enhance their safety with this invention.

Those machines in which the user is normally in a given operating position, and in which danger is presented by movement of the user away from that position during machine operation, may benefit much from the use of this invention. For example, if a user trips or falls from the machine such movement will pull key 10 from the keyway housing 50 to deactivate the machine. The treadmill is but one of many possible applications.

The angle 92 between the "ON" and "OFF" positions is shown as 20 degrees. Preferably, the angle is such that the "ON" and "OFF" positions are readily obvious, but the stroke 94 between positions is minimized to reduce the size of the keyway housing 50.

The switch activation apparatus of this invention may be generally constructed of metal, plastic or other generally rigid material. The required flexure of resilient arm 18 is minimal, so that plastic or metal materials may be used for the arm as well. In the preferred embodiment, the key 10 is constructed of a rigid plastic, and the reduced thickness of the arm results in the required flexibility.

The switch actuator 70 is preferably located within second depression 66 so that it is not easily accessible to activation by a tool, i.e. screwdriver inserted into the keyway. If desired, however, less critical machines may use adaptation in which the actuator 70 is depressed and activated by another portion of the key 10.

Actuator 70 may be a push button, or may be a lever or other type of actuator actuatable by the key.

The embodiment of key and keyway is exemplary of the invention. For various applications, the location of protrusion, switch, and guideway may be varied as desired.

Guideway 62 is shown as a groove in this example. Alternatively, it may comprise a ridge or ridges, or other construction which intercepts and guides the protrusion.

Reference herein to details of the illustrated embodiments is not intended to restrict the scope of the appended claims which themselves recite those features regarded as important to the invention.

We claim:

1. An apparatus for activating and deactivating an electrically powered machine, comprising:

a keyway adapted to receive a safety key, said keyway having a keyway housing with a base, side walls, a curved rear wall and a cover, said keyway having a key-insertable portion defining an "off" position, and a non key-insertable portion defining an "on" position, said keyway having an arcuate guideway to guide said safety key between an "OFF" position and an "ON" position;

an electrical switch having actuator means adapted to be actuated by said safety key when in said "ON" position; and a safety key having a proximate end for operation by the user and an arcuate distal end for insertion in said key insertable portion of said keyway whereby said arcuate distal end pivots within said curved rear wall of the safety keyway housing between said "OFF" position in which said electrical switch is deactivated and said "ON" position in which said electrical switch is activated, said safety key including protrusile means for movement in said guideway wherein said protrusile means engages said guideway to hold said safety key in one of said "ON" or "OFF" positions and said protrusile means prevents said safety key being inserted into said non key-insertable portion.

2. The apparatus of claim 1, wherein a dimension of said keyway is enlarged in said key-insertable portion to permit insertion of said key therein and wherein a dimension of said non key-insertable portion is reduced to block insertion of said key therein.

3. The apparatus of claim 2, wherein said dimension of said key-insertable portion permits passage of said protrusion therethrough, and said dimension of said non key-insertable portion obstructs passage of said protrusion thereinto while permitting removal of said key therefrom.

4. The apparatus of claim 2, wherein said dimension of said key-insertable portion decreases with insertion distance to communicate with said protrusion and compress said protrusion toward said key.

5. The apparatus of claim 4, wherein said key includes means for attachment to a user of said machine, wherein movement of said user removes key from said keyway to deactivate said machine without hand manipulation of said key.

6. The apparatus of claim 5, wherein said attachment means comprises a lanyard having one end attached to said key and the opposite end having means attachable to said user.

7. The apparatus of claim 1, wherein said key is movable from said "OFF" position to said "ON" position by rotation about said distal end of said key.

8. The apparatus of claim 1, wherein said guideway comprises a groove having depressions therein for retaining said protrusion in said "OFF" and said "ON" positions.

9. The apparatus of claim 1, wherein said key is formed of plastic by one-piece molding.

10. An apparatus for activating and deactivating an electrically powered machine, said apparatus comprising:

a keyway adapted to receive a safety key, said keyway having a keyway housing with a base, side walls, and a cover, said keyway having a key-insertable portion defining an "OFF" position, and a non keyinsertable portion defining an "ON" position, and said keyway guides said safety key between an "OFF" position and and "ON" position;

an electrical switch having actuator means adapted to be actuated by said safety key when in said "ON" position; and a safety key having a proximate end for operation by the user and a distal end for insertion in said key-insertable portion of said keyway, said keyway having a guideway extending between said "ON" and "OFF" positions, said safety key including protrusile means comprising resilient means with a protrusion positioned to extend normally away from said safety key and adapted to flex with said resilient means to prevent said safety key from being inserted into said non key-insertable portion and permit said safety key to be inserted into said key-insertable portion, said protrusile means positioned to move in said guideway between said "OFF" position in which said electrical switch is deactivated and said "ON" position in which said electrical switch is actuated when said safety key is inserted in said keyway and retain said key in one of said "ON" or "OFF" positions.

11. The apparatus of claim 10, wherein the key has a thickness and said thickness is selected to provide substantial rigidity thereof, and said resilient means comprises an elongate arm portion of said key, said arm portion having a proximate end fixedly connected to said key and a distal end having a protrusion extending normally away from said key, said arm portion being of reduced thickness for increased flexibility for compressional movement of said protrusion towards said key.

12. A safety switch apparatus for activating and deactivating an electrical machine, comprising:

a keyway housing having a first keyway opening for insertion of a key to a fully inserted "OFF" position, and a second keyway opening wherein insertion of said key is blocked, said keyway housing including a guideway for guiding said key between said "OFF" position and an "ON" position;

a key insertable in said first keyway opening and movable between said "OFF" position and said "ON" position; and means for directly retracting said key through said second keyway opening from said "ON" position without passing through said normal "OFF" position.

13. An apparatus for activating and deactivating an electrically powered machine, comprising:

a keyway adapted to receive a safety keyway, said keyway having a keyway housing with a base, side walls, and a cover, said keyway having a key-insertable portion defining an "OFF" position and a non keyinsertable portion defining an "ON" position, and said keyway guides said safety key between an "OFF" position and an "ON" position;

an electrical switch having actuator means positioned for actuation by said safety key when in said "ON" position; and a safety key having a proximate end for operation by the user and a distal end for insertion in said key-insertable portion of said key said keyway having a guideway extending between said "ON" and "OFF" positions, said safety key including protrusile means in communication with said guideway for movement in said guideway from said "OFF" position in which said electrical switch is deactivated to said "ON" position in which said electrical switch is activated to operate said actuator means against a first resistance wherein said protrusile means engages said guideway to hold said safety key in one of said "ON" or "OFF" positions, said safety key being capable of removal from said keyway through said non key-insertable portion from said "ON" position against a second resistance without passing through said "OFF" position.

14. An exercise treadmill including: an electrically powered endless belt;

a support console supported above said endless belt; and apparatus carried by said console for activating and deactivating said electrically powered endless belt, said apparatus comprising;

a keyway adapted to receive a safety key, said keyway having a keyway housing with a base, side walls, a curved rear wall, and a cover, said keyway having a key-insertable portion defining an "OFF" position and a non key-insertable portion defining an "ON" position and said keyway having a guideway to guide said safety key between an "OFF" position and an "ON" position;

an electrical switch having actuator means positioned for actuation by said safety key when in said "On" position;

a safety key having a proximate end for operation by the user and an arcuate distal end for insertion in said keyinsertable portion of said keyway whereby said arcuate distal end pivots within said curved rear wall of the safety keyway housing between said "OFF" position in which said electrical switch is deactivated and said "ON" position in which said electrical switch is activated, said safety key including protrusile means for arcuate movement in said guideway when said arcuate distal end of said safety key is pivoted against the curved rear wall of the keyway wherein said protrusile means engages said guideway to hold said safety key in one of said "ON" or "OFF" positions and said protrusile means prevents said safety key from being inserted into said non key-insertable portion;

a flexible tether sized to extend from said support console to a user positioned on said exercise treadmill, said tether having a first end secured to the proximate end of said safety key; and a second end secured to the user positioned on said exercise treadmill.

* * * * *